United States Patent [19]

Bewersdorf

[11] 3,931,963

[45] Jan. 13, 1976

[54] FOLDING MACHINES

[75] Inventor: Elmer D. Bewersdorf, Downers Grove, Ill.

[73] Assignee: McCain Manufacturing Corporation, Chicago, Ill.

[22] Filed: Mar. 5, 1975

[21] Appl. No.: 555,698

Related U.S. Application Data

[63] Continuation of Ser. No. 385,970, Aug. 6, 1973, abandoned.

[52] U.S. Cl. ..... 270/61; 270/86

[51] Int. Cl.[2] ..... B65H 45/00

[58] Field of Search ..... 270/61, 41, 86, 94; 83/505, 1; 93/58.1, 58.2, 58.2 F, 84; 52

[56] References Cited

UNITED STATES PATENTS

| | | | |
|---|---|---|---|
| 1,186,970 | 6/1916 | Cottrell | 270/41 |
| 3,270,628 | 9/1966 | Clem | 93/52 |
| 3,365,192 | 1/1968 | Giletta | 270/86 |
| 3,386,323 | 6/1968 | Dovey | 83/505 |

FOREIGN PATENTS OR APPLICATIONS

| | | | |
|---|---|---|---|
| 386,372 | 1/1933 | United Kingdom | 270/86 |

*Primary Examiner*—Robert W. Michell
*Assistant Examiner*—Vincent Millin
*Attorney, Agent, or Firm*—Kinzer, Plyer, Dorn & McEachran

[57] ABSTRACT

A folding machine having opposed discs respectively presenting a yieldable and an unyieldable annulus in tangential contact for imparting a score line to a sheet fed therebetween, inverting the scored sheet, the scored sheet after inverting is then folded (as by folding belts) to form a backbone after which the backbone is creased by being squeezed along its length to finish the fold.

15 Claims, 12 Drawing Figures

200
193
198
188
199
194
79G
78G
181
180
184
197
193
200
199
192
43
194
78
149A
226
152
79
B'
185
155
147
148
186
148
156
230
222
223
154
198
149
SLO-SLI
157

184
181
78G
79G
180
190
184S
188
185
191
79
78
78S
79S 80
87
86
85
84
81

87
86
80A
84A
85A
81A

FOLDING MACHINES

This is a continuation of application Ser. No. 385,970, filed Aug. 6, 1973, now abandoned.

This invention relates to a machine for folding a sheet of paper and in particular to a machine for folding the cover of a magazine or the like.

The texture of certain papers sheets such as magazines covers may vary considerably from the standpoint of thickness and the tendency to crack when folded. Personal experience will reveal this to be true in that a neat fold in a paper sheet can sometimes be accomplished quite easily by a mere sliding motion of the thumb and forefinger. On the other hand, heavy textured sheets, particulary those of poor quality, cannot be neatly folded, but to the contrary, the fold tends to become ragged or indistinct, and sometimes the paper itself cracks.

Personal experience is scarcely different from that encountered by publishers concerned with imparting a neat fold in a book or magazine cover. More specifically, the texture of the cover may require a starting fold which is the inverse of the final fold, which is to say that the type of paper involved, in order to avoid cracking, may require the formation of a score line located on the expanded side of the final fold rather than on the compressed or inside of the fold.

Accordingly, it is an object of the present invention to construct a folding machine in which the sheet is first scored along a continuous line before any fold is created, and a related object of the present invention is to enable the depth or intensity of the score to be varied in accordance with the fact that the type of paper being folded in one run of the machine may be quite different from the type of paper fed through the machine in a subsequent run. Specifically an object of the present invention in this regard is to score the sheet to be folded by means of opposing discs in tangential contact respectively presenting a sharp, unyielding annulus and a yieldable annulus, one of the discs being supported on an adjustable axis thereby to vary the depth of the score of accordingly as the paper cover may require a deep score or a shallow score for the better fold. A related object of the invention is to construct one of the discs of separable members enabling either the yieldable or unyieldable annulus alternately to be housed therebetween so that the discs in effect may be reversed for scoring the obverse side of one sheet or the reverse side of the sheet of different texture.

The foregoing arrangement involving opposed scoring annuli enables a score line of predetermined intensity to be achieved, a start of the fold, so to speak. Having established a commencing or start fold that takes into account the quality of texture of the paper, it is possible to finish the fold by means of squeeze rollers without crushing the paper. It is therefore a further object of the present invention to construct the machine to include a pair of squeeze rollers for attaining the finished fold and so to do constitutes a further object of the present invention. Another object of the invention in this regard is to support at least one of the squeeze rollers on an adjustable axis relative to the axis of the other roller thereby to vary the separation or bight, allowing the sharpness of the finished fold to be varied.

As will be explained hereinafter, the present machine utilizes a known arrangement of folding belts, disposed between the scoring discs and the squeeze rollers. The folding belts present a flight of interfitting V-shaped elements to which the scored sheet is delivered from the scoring discs; the folding belts gradually bend the sheet to form a so-called backbone, after which the backbone is presented to the squeeze rollers which are responsible for the finished fold. Again, because of variable paper texture, it may be desirable to regulate the manner in which the folding belts bend the sheet about the score line. In this regard it is a known practice to adjust the spacing between the folding belts to establish a predetermined rate of closing the fold, whether the folding belts shape the fold quickly and sharply, or slowly and bluntly, or somewhere in between. Variation in the spacing of the folding belts entails a change in the attitude of the backbone of the folded sheet emerging from the folding belts and since the sheet thus folded is delivered to the squeeze rollers, it is a further object of the present invention to mount and support the squeeze rollers in such a fashion as to enable the position of the bight therebetween to be changed in accordance with the attitude of the backbone being delivered by the folding belts to the squeeze rollers.

Other and further objects of the present invention will be apparent from the following description and claims and are illustrated in the accompanying drawing which, by way of illustration, shows a preferred embodiment of the present invention and the principle thereof, and what is now considered to be the best mode contemplated for applying that principle. Other embodiments of the invention embodying the same or equivalent principles may be used and structural changes may be made as desired by those skilled in the art without departing from the present invention.

Figure 1:
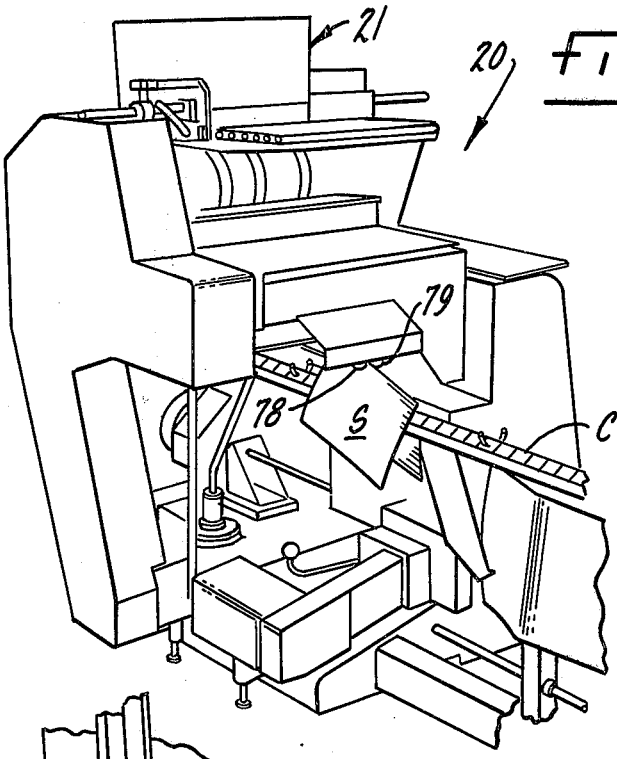
FIG. 1 is a perspective view of the machine.

A perspective view of the present machine 20 is presented in FIG. 1. The sheets to be folded will be arranged in a vertical stack in a supply magazine 21. As described in detail below, the bottom most sheet in the supply stack is fed forward sequentially, first to a pair of tangentially opposed scoring discs, after which the scored sheet is inverted and is delivered to a pair of opposed folding belts. The sheet emerging from the folding belts is then creased and the sheet S, FIGS. 1 and 11, having the finished fold, may be dropped onto a conveyor CV of the so-called saddle type.

Figure 2:
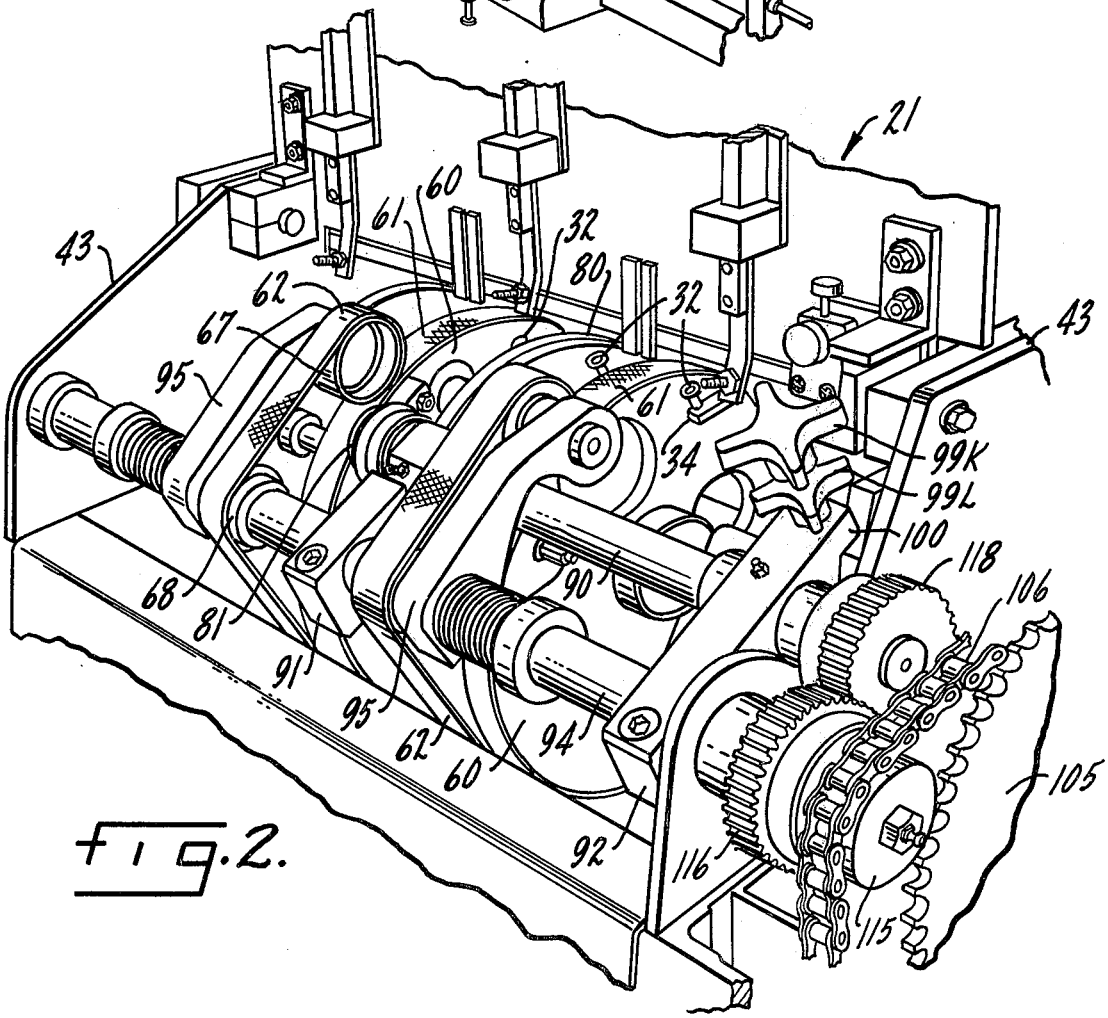
FIG. 2 is a fragmented perspective view of a portion of the machine at the side opposite that visible in FIG. 1.
Figures 3, 5:
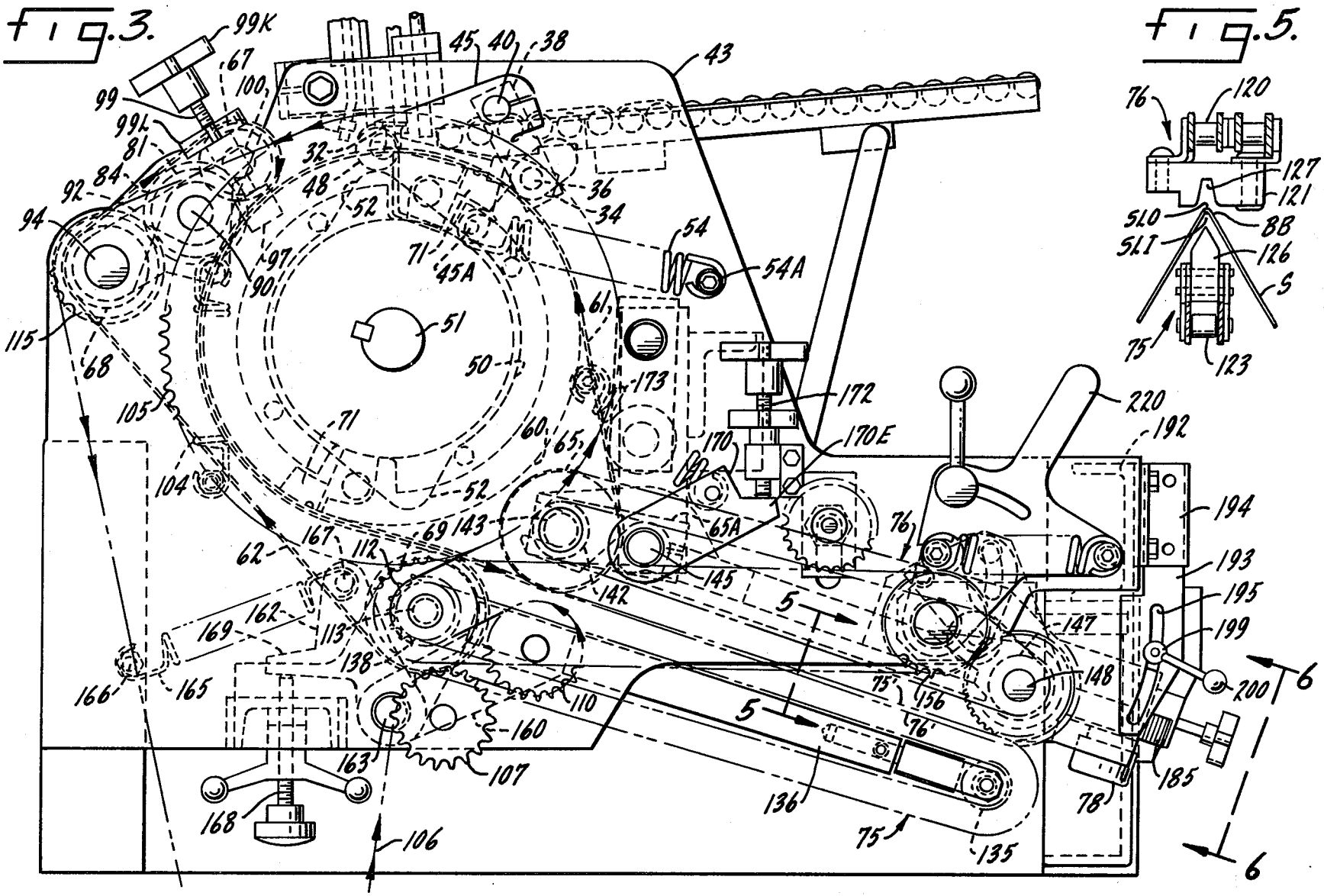
FIG. 3 is a side elevation of a portion of the machine.
FIG. 5 is a sectional view substantially on the line 5—5 of FIG. 3.
Figure 4A:
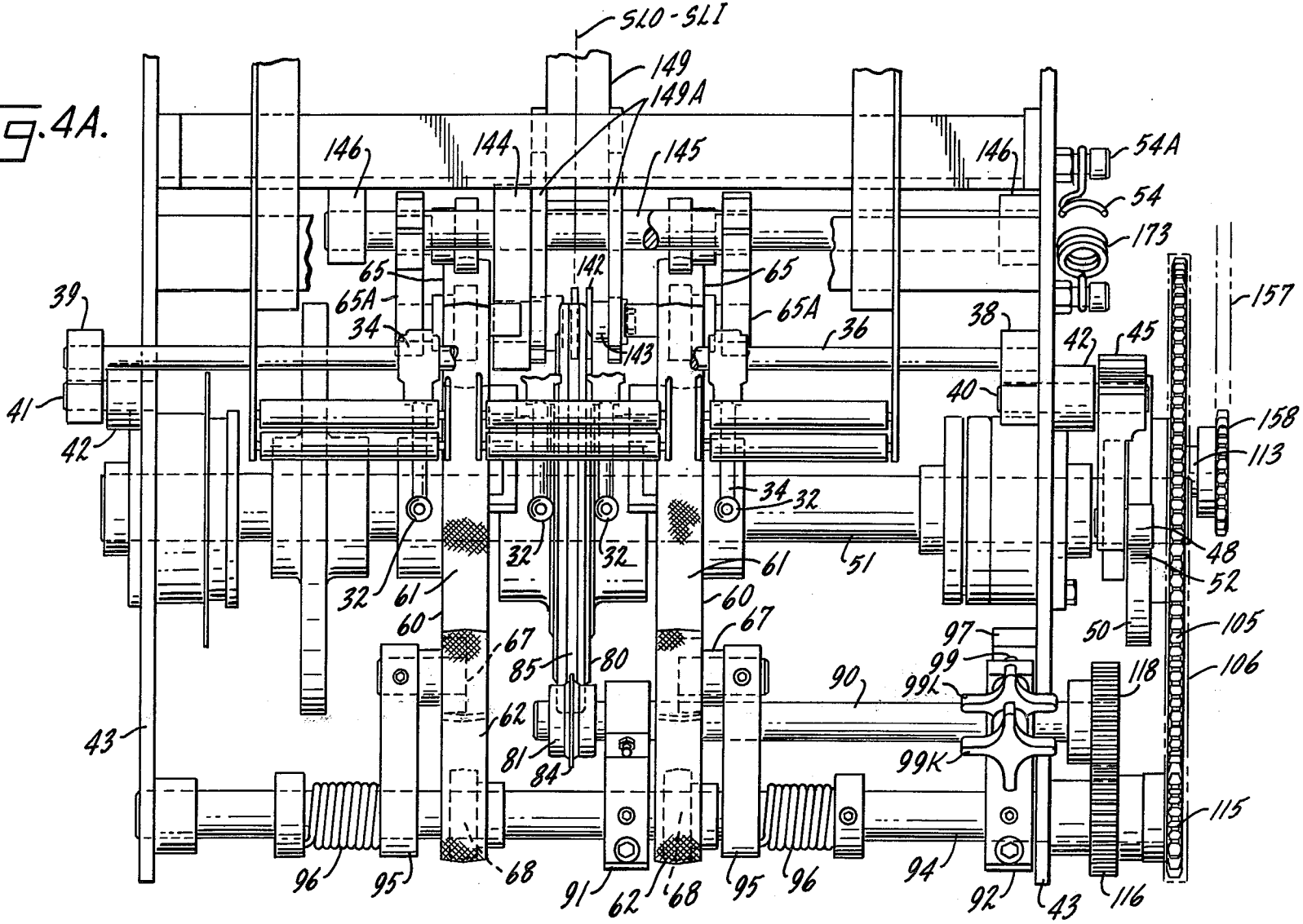
FIG. 4A is a top plan view of the structure shown in FIG. 2.

Referring to FIGS. 2, 3 and 4, a plurality of suction cups 32 are arranged at the front of the supply magazine in position to engage the underside of the bottom most supply sheet. As best seen in FIG. 4A, the suction cups 32 are carried by arms 34. The arms 34 extend rearwardly beneath the supply magazine and the ends thereof opposite the suction cups are fixed to a support shaft 36. Shaft 36 at opposite ends is carried by arms 38 and 39. The upper end of arm 38, as viewed in FIG. 3, is secured to a rock shaft 40 while arm 39 is pivoted on a stub shaft 41, FIG. 4A. The shafts 40 and 41 are supported for rotation in bushings 42 in turn secured to the side plates 43 of the machine.

Rock shaft 40, FIG. 4A, extends beyond bushing 42 and a lever 45 is fastened thereto. The arrangement is such that when lever 45 is oscillated, arms 38 and 39 in turn are raised or lowered as the case may be, respectively to present the suction cups 32 to the bottom most sheet in the supply stack and subsequently to pull the bottom most sheet downward incidental to forward feeding as hereinafter described.

Referring to FIG. 3, lever 45 is provided at the forward end thereof with a cam follower 48. A cam plate 50 is secured for rotation to a driven shaft 51. The cam plate 50 has two lobes 52 of 180° separation, the cam lobes being effective on cam follower 48 to oscillate lever 45. It will be realized that the cam lobes 52 are responsible to raise the suction cups twice in each cycle of the shaft 51 so that two sheets are successively withdrawn from the supply magazine in a single cycle of shaft 51. The suction cups are valved in a known manner.

Lever 45 is provided with a pin 45A which is secured to one end of a tension spring 54, FIG. 3, the opposite end of the spring being anchored to a pin 54A on the side plate 43, whereby the spring constantly presents the cam follower 48 to the peripheral contour of cam plate 50.

The suction cups 32 in their downward motion, and at the same time when suction or negative pressure prevails, present the extracted sheet to the periphery of a pair of cylinders 60, FIG. 2, provided with feed tapes 61. The cylinders 60 are secured to the driven shaft 51, and the tapes 61 are opposed to a pair of related feed tapes 62, FIG. 2. Referring to FIG. 3, the feed tapes 61 driven by the cylinders 60 are played around idler wheels 65. The opposed tapes 62 engage the tapes 61 as shown in FIG. 3 so as to be driven thereby, and are played around idler wheels 67, 68 and 69, FIG. 3.

The cylinders 60 are provided with well known sheet grippers, now shown, which are effective to clamp the leading edge of the extracted supply sheet to a gripper seat or anvil 71 carried by each cylinder 60. As shown in FIG. 3, there are two gripper seats 71 on each cylinder 60, separated by 180°, accordingly as two sheets are extracted successively from the supply magazine in each cycle of driven shaft 51.

Thus it will be seen from the foregoing that the suction cups and the sheet grippers constitute a means for extracting and withdrawing a sheet from the supply magazine, the grippers being effective to withdraw the extracted sheet forwardly or counterclockwise as viewed in FIG. 3, delivering the sheet to the bight between the feed tapes 61 and 62. It will be appreciated from FIG. 3 that the withdrawn sheet is in effect inverted as it travels counterclockwise with the cylinders 60. As described hereinafter in detail, the inverted sheet is delivered to a pair of opposed folder belts 75 and 76, FIGS. 3 and 9, which bend the sheet to form the so-called backbone. The sheet as folded by the folder belts 75 and 76 is delivered to a creasing means in the form of a pair of squeeze rollers 78 and 79, FIG. 1 and 6. Shortly after the sheet is withdrawn from the supply magazine, it is scored in a manner now to be described.

Referring to FIG. 4A, a large scoring disc 80 is secured to the driven shaft 51, being disposed between the two feed cylinders 60; an opposed scoring disc 81 of smaller diameter is arranged in tangentially opposed relation to the scoring disc 80 to define a bight for receiving the sheet to be scored.

In the embodiment shown in FIG. 4A, the scoring disc 81 is provided with an unyieldable (steel) scoring annulus 84, whereas the opposed scoring disc 80 presents a yieldable annulus 85 represented by a suitable elastomer. The two annuli are engaged in opposed relation as will be evident from FIG. 3 and it will be recognized that a continuous score line will be formed on the upper or outside face of the sheet fed therebetween. Consequently, bearing in mind that the scored sheet is inverted prior to being delivered to the folding belts 75 and 76, the score line will be on the inside of the fold.

Figure 7:
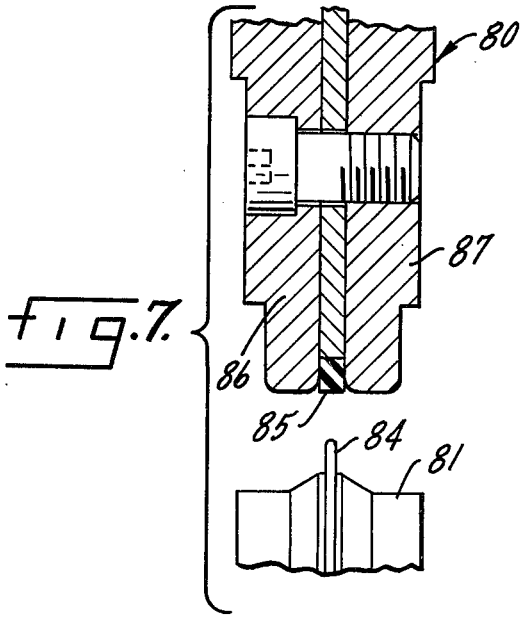
FIG. 7 is a fragmented, compound view showing another relation of the scoring discs.

A detail view of the two scoring discs is shown in FIG. 7, the relation being that shown in FIGS. 2 and 3 where the rigid or non-yieldable annulus 84 is carried by the small disc 81. The other scoring disc, disc 80, FIG. 7, comprises a pair of suitable plates 86 and 87, housing therebetween the elastomeric annulus 85.

Figure 8:
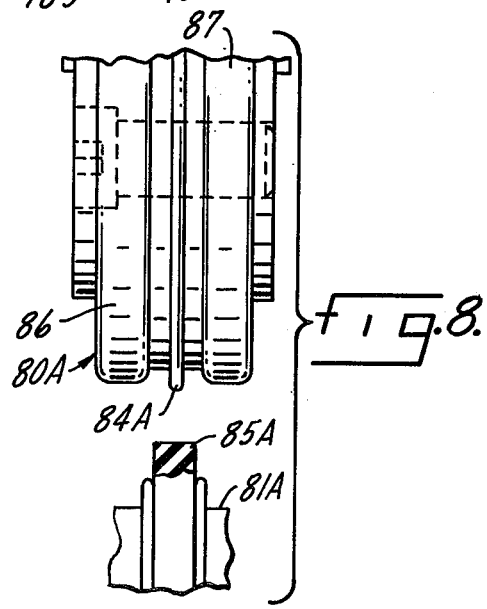
FIG. 8 is a view similar to FIG. 7 showing another relation of the scoring discs.

The arrangement may be reversed, FIG. 8, in the sense that the larger disc presents the non-yielding annulus, whereas the smaller disc presents the yieldable annulus, as a result of which the score line will be at the underside of the sheet. Thus as shown in detail in FIG. 8, an alternate embodiment is one wherein the smaller scoring disc 81A presents an elastomeric annulus 85A while the opposed scoring disc 80A presents the unyielding annulus 84A. By disassembling the plates 86 and 87, FIG. 7, the elastomeric annulus 85 may be removed and supplanted by a rigid annulus 84A, FIG. 8. It will be appreciated that the sharpness of the scoring edge of the rigid annulus may be pre-selected.

With the reverse arrangement shown in FIG. 8 the score line will be at the underside of the supply sheet, as noted, and hence the score line will be on the outside of the fold.

The smaller scoring disc, FIG. 4A, is carried at one end of a shaft 90. Shaft 90 is supported by a pair of arms 91 and 92 each pivotally mounted on a shaft 94 which also serves as a support for arms 95 which carry the idler wheels 67 related to the feed tapes 62. Torsion springs 96 are anchored on shaft 94 and the free ends thereof are effective to urge the idler arms 95 clockwise as viewed in FIG. 2 yieldable to engage the tapes 62 with the driven tapes 61. It will be apparent that arms 95 may be lifted to open the bight between the opposed tapes 61 and 62 incidental to clearing a jam or a misfeed.

Shaft 90, which carries the scoring disc 81, may be raised or lowered as viewed in FIG. 3 to vary the intensity or depth of the score line. To this end, the side plate 43 at the right hand side of the machine, FIG. 4A, is provided with a stop 97. The lower end of an adjusting screw 99, FIG. 3 and 4A, mounted in a tapped ear 100 included as part of arm 92, bears against the stop. Arm 92 is tensioned by a spring 104, FIG. 3, holding the screw 99 against the stop 97. Screw 99 is provided at its upper end with a knob 99K, FIG. 2, and an interposed lock nut 99L is provided. By loosening lock nut 99L, the screw 99 may be turned, moving arm 92 about shaft 94 as a center, raising or lowering shaft 90 which carries the scoring disc 81. Spring 104 is responsible for urging the upper, smaller scoring disc 81 against the annulus of disc 80, and the extent of this force, and therefore the depth of the score, may be regulated by screw 99.

Figure 11:
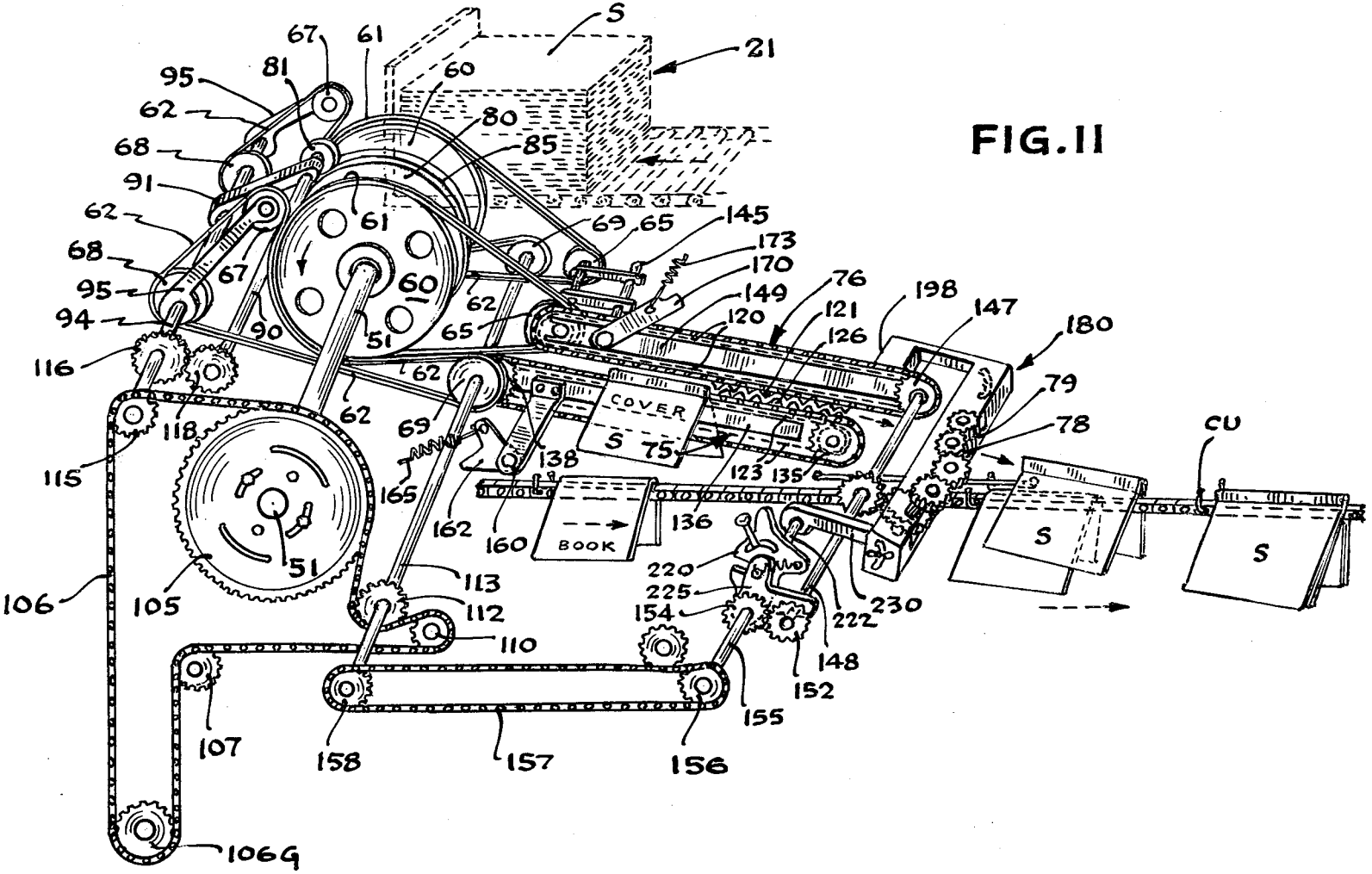
FIG. 11 is a partly schematic view of certain parts of the machine.

As noted above, shaft 51 is a driven shaft, being provided with a large drive sprocket 105, FIGS. 2, 3 and 11. A chain 106 is driven by a drive gear 106G, FIG. 11. The power sources for driving gear 106G is not shown. The chain 106 is trained around an idler sprocket 107, from thence upwardly to a tensioning sprocket 110 and then is trained around a driving sprocket 112, passing from thence to drive sprocket 105 secured to driven shaft 51. Sprocket 112 drives a shaft 113, FIG. 11.

Chain 106 as best shown in FIG. 2, at the upper stretch thereof, is trained around a drive sprocket 115 secured to the hub of a gear 116. Gear 116 is meshed with an opposed gear 118 fixed to one end of shaft 90 which carries the scoring disc 81. Thus it will be seen that shafts 51 and 90 which carry the opposed scoring discs are both driven. This is contrary to the expectation that only one of the scoring discs would be driven, idling the other; for if one scoring disc is to drive the other by friction, then excessive pressure would be required, with the possible effect of actually cutting the paper rather than scoring it. Consequently, both scoring discs are positively driven thereby allowing the depth of the score line to be selected in terms of the type of paper.

Reference was made above to the folder belts 75 and 76, FIG. 3. The folder belts are of a known construction and themselves constitute no part of the present invention. Nonetheless a detail view is presented in FIG. 5 wherein it will be noted that the upper folder belt 76 is supported by a carrier chain 120, of double strand form, and which supports a plurality of forming dies as 121.

The opposed or lower folder belt 75 comprises a single strand chain 123 which carries a plurality of what may be viewed as a punch or male member as 126 configured generally complemental to the notch or forming groove 127 in the die member 121.

Figure 9:
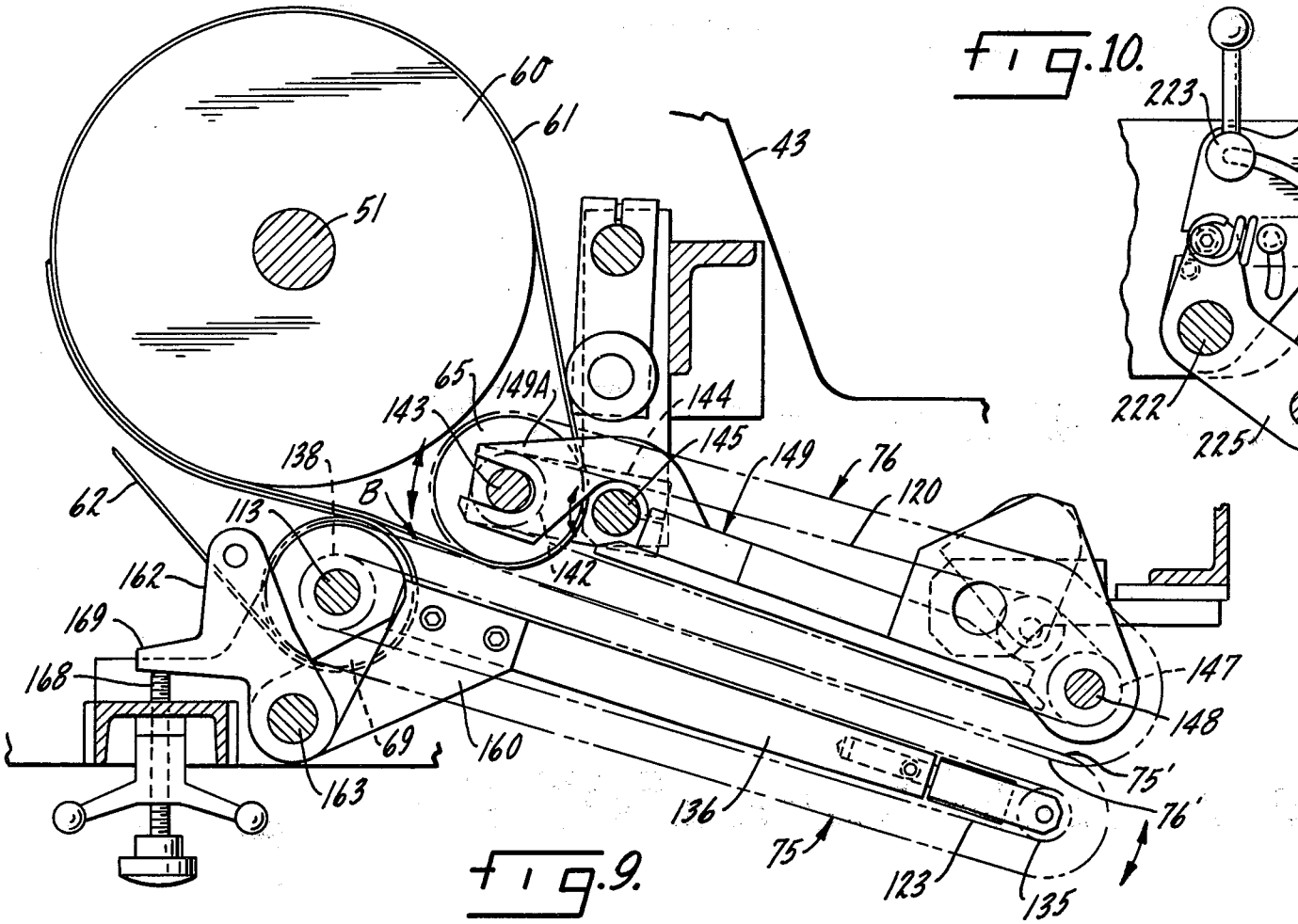
FIG. 9 is a view similar to FIG. 3, but partly in section, showing in particular the means for adjusting the folding belts.

The scored sheet is delivered to the bight B, FIG. 9, between the opposed flight of the folder belts, an infeed position approximating the lower tangent of the idler 65, FIG. 9. At this point, there is sufficient clearance between the forming elements 121 and 126, FIG. 5, to admit the sheet; thereafter, the forming elements gradually converge in the direction of the squeeze rollers as 78 and this convergence is shown by the gradually increasing overlap, FIG. 3, between the opposed runs or flights of the folder belts identified by reference characters 75′ and 76′, meaning that male elements 126 gradually penetrate the die slots 127, and the sheet S, FIG. 5, trapped therebetween is gradually folded or bent about the previously formed score line to shape the backbone of the sheet, BB. As indicated in FIG. 5, the score line may be located at the outside of the backbone BB, at SLO or it may be located at the inside, SLI.

Carrier chain 123 at its opposite ends is trained around a pair of spaced sprockets; one such sprocket is identified by reference character 135, FIG. 3, and is supported for rotation at one end of a long arm 136 which allows the lower folder belt to be adjusted as hereinafter described. The carrier chain 123 is trained around a drive sprocket 138 driven by shaft 113, FIGS. 3 and 9.

Thus it will be seen that sprocket 138 is the drive sprocket for chain 123 which carries the folder elements 126 of the lower folding belt assembly 75; sprocket 135 is an idler sprocket. Having described the manner in which the lower folding belt assembly 75 is driven, consideration will now be given to the drive for the upper folder belt assembly 76.

The chain 120 which supports the upper folder elements 121 FIG. 5, is trained around an idler sprocket 142 which is carried on a stub shaft 143, FIG. 9, supported by an arm 144 clamped to a rock shaft 145. The rock shaft 145, FIG. 4A, is journalled in a pair of fixed bushings 146.

The opposite end of chain 120 is trained around a driven sprocket 147 fixed to a drive shaft 148, FIG. 9, whereby drive shaft 148 is effective to drive the sprocket 147.

Figure 4B:
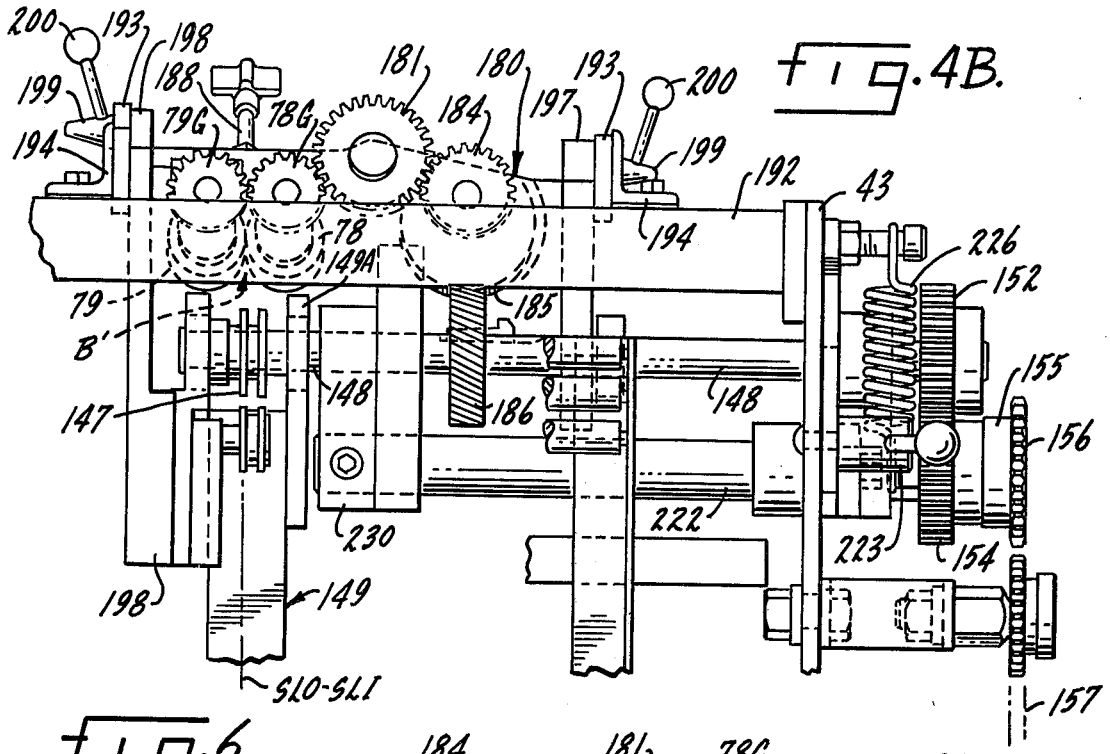
FIG. 4B is a detail plan view of the means which drive the squeeze rollers.

Sprocket 147 is supported at one end of an arm 149, FIGS. 4A, 4B and 9. Arm 149 at the opposite end is provided with bifurcations 149A, FIG. 9, which cradle stub shaft 143. Arm 149 is pivotally supported coaxial with drive shaft 148, FIG. 4B.

Drive shaft 148, FIG. 4B, is provided at one end with a drive gear 152 meshed with a transmitting gear 154 fixed to a stub shaft 155. Stub shaft 155 is provided with a driven sprocket 156 around which is trained a chain 157, the opposite end of chain 157 being trained around a sprocket 158, FIG. 11, fixed to driven shaft 113 referred to above.

As noted above, arm 136, FIGS. 3 and 9, enables the lower folder belt 75 to be adjusted. To this end, arm 136 is pivotally supported on an axis coaxial with shaft 113, and hence arm 136 may be viewed as a cantilever. A bracket 160 is secured at its upper end to arm 136. The lower end of bracket 160 is joined to a lever 162 pivotally mounted at 163, FIG. 9. One end of a spring 165, FIG. 3, is secured to a stud 166 supported by the side plate of the machine, and the opposite end of this spring is anchored to a stud 167 fixed to the upper end of lever 162.

Lever 162 and bracket 160 thus constitute a bell crank pivoted at 163, FIG. 9, and spring 165 is effective to bias this bell crank assembly counterclockwise as viewed in FIG. 9, tending to pivot arm 136 counterclockwise about its pivotal axis. The prevailing attitude of arm 136, and therefore the attitude of folder belt 75 with respect to the opposed belt 76, is determined by adjusting screw 168, the free end of which bears against and acts as a stop with respect to an ear 169 included as part of lever 162.

By elevating the stop presented by screw 169, arm 136 may be dropped a corresponding increment, which drops sprocket 135 and in effect retracts folding elements 126, FIG. 5, relative to the notches 127 of the opposed folding elements associated with the upper folding belt 76.

Similarly, by dropping stop 169, spring 165 is effective to rock arm 136 upward a corresponding increment to tighten or decrease the separation between the folding elements 126 and 127.

A similar adjustment is provided for the upper folder belt as will now be described.

Arm 144 which supports shaft 143 of idler sprocket 142 for chain assembly 76 is secured to rock shaft 145, FIGS. 4A and 9, as already noted. An arm 170, FIGS. 3 and 11, is secured to rock shaft 145. Arm 170 has an ear 170E in engagement with the lower end of an adjusting screw 172, FIG. 3. A tension sring 173 is effective in the manner of spring 165 described above to bias arm 170 upwardly or counterclockwise as viewed in FIG. 3, to a position determined by engagement between ear 170E and the screw 172, tending to oscillate rock shaft 145 and the arm 144 secured thereto, in turn raising or lowering arm 149 about shaft 148 as a center. Consequently, by adjusting screw 172, the arm 149 may be raised or lowered independently to vary the attitude of the upper folder belt assembly 76 relative to the lower assembly 75. The upper folder belt will be adjusted about shaft 148 as a pivot center principally to widen or narrow the bight B for the sheet to be folded.

Thus it will be seen that the folder belts may be adjusted independently to vary the attitude of the opposed folder belt flights 75' and 76' and especially the bight B, FIG. 9. The upper folder belt 76 may be adjusted about another center as will be described below.

It may also be observed at this point that the idler wheels 65, FIG. 4A, are supported for rotation at one end of arms 65A, the latter being clamped for support to rock shaft 145. Therefore, when shaft 145 is adjusted to adjust the upper belt 76, it may be necessary to relocate the idlers 65, this being accomplished by loosening the clamps which secure arms 65A to shaft 145.

Figure 6:
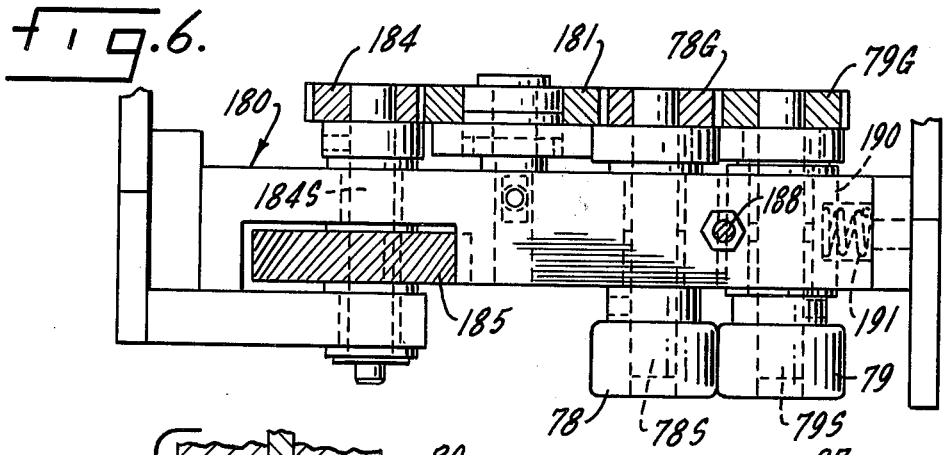
FIG. 6 is an end elevation substantially on the line 6—6 of FIG. 3.

A carriage 180, FIG. 6, is provided for the creasing rollers and by referring to FIG. 4B it will be noted that the creasing rollers 78 and 79 present a bight B' which is aligned with center line SLO-SLI corresponding to the backbone score or fold line identified in FIG. 5, recalling that the score line may be on the outside or the inside of the backbone depending upon the relationship of the scoring discs, FIGS. 7 and 8.

The creasing rollers 78 and 79 are fixed to the lower ends of respective drive shafts 78S and 79S, FIG. 6. These drive shafts are supported for rotation in carriage plate 180. The upper ends of shafts 78S and 79S are provided with gears 78G and 79G meshed with one another and driven by an intermediate gear 181, FIG. 4B. One of the creasing rollers, as will be described below, is supported for lateral adjustment toward and away from the opposed roller so that the space defining the creasing bight B' may be adjusted to vary the firmness of the final crease.

Gear 181 is driven by a spur gear 184 and its shaft 184S, FIG. 6, is driven by a worm wheel 185 secured thereto, the worm wheel in turn being driven by a worm gear 186 fixed to drive shaft 148 as shown in FIG. 4B.

It was mentioned that one of the creasing rollers is adjustable. This is attained by supporting shafts 79S in a bearing block 190, FIG. 6, housed within carriage plate 180. A compression spring 191 is housed within carriage plate 180 and presses against the bearing block, biasing roller 79 against opposed roller 78.

Thus the bearing block 190 is free to slide laterally to a limited extent within the related recess in the carriage plate 180. The spacing between rollers 78 and 79 is determined by an adjusting screw 188, FIG. 4B, having a tapered inner end.

In actual practice, the attitude of the folding belts, adjusted through operation of the screws 168 and 172, may be changed as much as 2 inches and therefore it becomes important to have the creasing rollers 78 and 79 supported for corresponding adjustment. The manner in which this is accomplished will now be described.

Referring to FIG. 4B a support plate 192 is secured to the side plates, as 43, of the machine. A pair of legs 193, FIG. 3, are secured as by brackets 194, in spaced relation to plate 192. The legs 193 are slotted at 195, FIG. 3.

Carriage 180 includes a pair of end plates 197 and 198 provided with screws (not shown) extending outwardly therefrom and through the slots 195, clamp nuts 199, FIG. 4B, being mounted thereon. The clamp nuts have handles 200, such that the clamps nuts may be tightened against the outer face of legs 193 to hold plate 180, and therefore the creasing rollers 78 and 79, in an adjusted position. As shown in FIG. 4B, end plate 198, secured to carriage plate 180, is also secured to arm 149. Therefore, when the position of the creasing rollers 78 and 79 is varied, arm 149 is relocated (pivoting about shaft 143 as a center) by a like amount and the manner in which this is accomplished will now be described.

Figure 10:
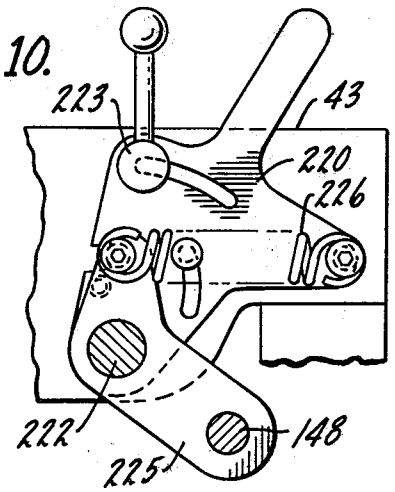
FIG. 10 is a detail sectional view of another adjustment means.

As shown in FIG. 10 an adjusting lever 220 is positioned at one side of the machine, being secured to a rock shaft 222. The adjusted position of lever 220 is maintained by a clamping nut 223 of the character described above. A bell crank arm 225 is secured to rock shaft 222 and hence when lever 220 is moved, oscillating shaft 222, arm 225 is moved in the same direction, clockwise or counterclockwise. Lever 220, when the clamping nut 223 is loosened, may be turned counterclockwise against the return force of a spring 226, FIG. 10

Rock shaft 222 as shown in FIG. 4B extends inwardly in the direction of arm 149 and a support arm 230 is secured to the inner end thereof. Arm 230 in turn rotatably supports drive shaft 148 and as shown in FIG. 10 shaft 148 is also supported by arm 225. Arm 197, part of carriage 180, is mounted on shaft 148. Hence when shaft 222 is rocked or oscillated, arm 230 and arm 225 are raised or lowered concurrently, whereby shaft 148 is relocated, and at the same time arms 197 and 198, part of carriage 180, are raised or lowered and arm 149 (upper folder belt) is repositioned accordingly, all about shaft 143, FIG. 9, as a center.

It will be seen from the foregoing that under the present invention the sheet is first scored, top or bottom selectively, by the opposed scoring discs 80 and 81. The scored sheet is inverted by feed tapes 61 and 62 and delivered thereby to the bight B, FIG. 9, between the folder belts 75 and 76, the latter gradually folding the sheet about the score line to shape the backbone BB, FIG. 5.

The bight between the scoring discs can be varied to vary the intensity or depth of the score line. One of the discs is constructed of separable side members (plates) so that either a yieldable or unyieldable scoring annulus may be selectively accommodated therebetween.

The entrance bight between the folder belts can be varied, for example to commence the fold instantly or later in the travel of the scored sheet moving therebetween. The degree of convergence of the folder belts can be varied to vary the intensity of the fold. The crease or squeeze rollers 78 and 79 accept the folded sheet emerging from the folder belts and impart the finish fold to the sheet delivered thereto. One of these rollers is on an adjustable (vertical) axis to vary the squeeze intensity. Since the attitude (angle) of the folding belts may vary considerably, the crease rollers may have to be raised or dropped by shifting lever 220 to center the squeeze rollers appropriately, and this is preferably accomplished by concurrently relocating arm 149 about shaft 143 as a center.

Hence while a preferred embodiment of the invention has been disclosed this is capable of variation and modification.

I claim:

1. A machine for folding the cover of a magazine or the like and feeding the cover to a conveyor located therebeneath, comprising: a supply hopper for supplying sheets constituting the covers to be folded, an opposed pair of rotatable discs presenting a bight between which is fed the sheet to be folded; one of said discs having an unyieldable annulus and the other of said discs having a yieldable annulus opposed thereto whereby the two annuli impart a score line to a sheet fed therebetween; means to feed the sheets one by one to said bight; opposed flights of folder elements beneath the discs for progressively folding the sheet on the score line to form a folded sheet having a backbone; means to invert the scored sheet and deliver it to said opposed flights; and means to crease the backbone along its length to impart a finish fold and to feed the folded sheet to said conveyor.

2. A folding machine according to claim 1 wherein one of said discs is supported on an adjustable axis to vary the depth of the score line.

3. A folding machine according to claim 1 wherein one of said discs comprises a pair of separable members enabling either annulus to be housed therebetween.

4. A folding machine according to claim 1 wherein one of said discs is supported on an adjustable axis to vary the depth of the score line, and wherein one of said discs comprises a pair of separable members enabling either annulus to be housed therebetween.

5. A folding machine according to claim 1 wherein the means to crease the backbone and feed the folded sheet to the conveyor comprises a pair of opposed squeeze rollers presenting a bight between which is fed the backbone of the folded sheet, one of said rollers being supported on an adjustable axis to vary the squeeze intensity.

6. A folding machine according to claim 5 wherein one of said discs is supported on an adjustable axis to vary the depth of the score line.

7. A folding machine according to claim 5 wherein one of said discs comprises a pair of separable members enabling either annulus to be housed therebetween.

8. A folding machine according to claim 5 wherein one of said discs is supported on an adjustable axis to vary the depth of the score line, one of said discs comprising a pair of separable members enabling either annulus to be housed therebetween.

9. A folding machine according to claim 1 wherein the means to crease the backbone comprises a pair of opposed squeeze rollers presenting a bight between which is fed the backbone of the folded sheet, one of said rollers being supported on an adjustable axis to vary the squeeze intensity, said opposed flights comprising an opposed pair of spaced folder belts of endless form presenting complemental male and female members for bending the sheet on the score line, said folder belts delivering the sheet to said squeeze rollers and being convergent toward said squeeze rollers gradually to shape the backbone, means to vary the separation between the folder belts, said squeeze rollers being supported for rotation in a carriage, said carriage being adjustable to enable the squeeze rollers to be centered with respect to the delivery of the folder belts, and the means for inverting the scored sheet and delivering it to the folder belts comprising opposed feed wheels and tapes interposed between the discs and the folder belts.

10. A folding machine according to claim 9 wherein one of said discs is supported on an adjustable axis to vary the depth of the score line.

11. A folding machine according to claim 10 wherein one of said discs comprises a pair of separable members enabling either annulus to be housed therebetween.

12. A folding machine according to claim 9 wherein one of said discs is supported on an adjustable axis to vary the depth of the score line, one of said discs comprising a pair of separable members enabling either annulus to be housed therebetween.

13. In a machine for folding a sheet constituting the cover of a magazine or the like and for feeding the folded sheet onto a conveyor: an opposed pair of rotatable discs above the conveyor presenting opposed surfaces to impart a score line to the sheet and defining a bight between which is fed the sheet to be folded; means to invert the scored sheet and deliver it for folding; opposed members for receiving the so-delivered sheet and gradually and continuously folding the sheet along the score line to form a backbone; a pair of creasing rollers to which the folded sheet having the backbone is delivered, and said creasing rollers imparting a finish fold and delivering the creased cover to the conveyor.

14. A machine according to claim 13 in which the opposed members have interfitting V-shaped elements for making the fold and being separated to afford a bight into which the scored sheet is delivered, both of said opposed members being adjustable to vary both the attitude thereof and the spacing therebetween, and said creasing rollers being supported for vertical adjustment in unison to have the bight thereof aligned with the bight of the opposed members.

15. A machine according to claim 14 in which the conveyor is a saddle conveyor.

* * * * *